US006095953A

United States Patent [19]

Lee et al.

[11] Patent Number: 6,095,953

[45] Date of Patent: Aug. 1, 2000

[54] MAGNETIC CONTROL OF EXERCISE BICYCLE

[75] Inventors: Mu-Yuan Lee, Ta Li; Chao-Chiun Chen, Taichung Hsien, both of Taiwan

[73] Assignee: High Spot Industrial Co., Ltd., Taichung Hsien, Taiwan

[21] Appl. No.: 09/211,272

[22] Filed: Dec. 14, 1998

[51] Int. Cl.[7] ..... A63B 22/06

[52] U.S. Cl. ..... 482/57; 482/51; 482/63; 188/164

[58] Field of Search ..... 482/51, 57, 61, 482/63, 64, 65, 903, 58, 59, 60; 188/164, 267.2, 24.11

[56] References Cited

U.S. PATENT DOCUMENTS 5,094,447 3/1992 Wang .
5,586,624 12/1996 Ko et al. ..... 188/164

*Primary Examiner*—Danton D. DeMille
*Assistant Examiner*—Tam Nguyen
*Attorney, Agent, or Firm*—Harrison & Egbert

[57] ABSTRACT

A magnetic resistance control apparatus for an exercise bicycle including a bicycle frame having a fork structure extending therefrom, a wheel having a magnetic surface thereon rotatably mounted on an axle within the fork structure, a pedal assembly rotatably connected to the bicycle frame and linked to the wheel such that a rotation of the pedal assembly causes a rotation of the wheel, a suspension arm connected to the fork structure and extending outwardly therefrom so as to have an end positioned beyond an outer diameter of the wheel, a suspension bar connected to the bicycle frame and extending therefrom so as to be positioned above an outer diameter of the wheel, an arc-shaped seat having magnets received on an interior surface thereof, extending around a portion of the wheel such that the magnets face the magnetic surface of the wheel, and a non-magnetic layer extending directly over the magnets of the seat so as to be interposed between the magnets and the wheel. The seat has an end pivotally connected to the end of the suspension arm. The seat is adjustably connected to the suspension bar so as to set a distance of the magnets from the wheel.

1 Claim, 7 Drawing Sheets

MAGNETIC CONTROL OF EXERCISE BICYCLE

FIELD OF THE INVENTION

The present invention relates generally to an exercise bicycle, and more particularly to an improved control of magnetic resistance for an exercise bicycle.

BACKGROUND OF THE INVENTION

The conventional exercise bicycle body (as shown in FIGS. 1 and 2) has a control for magnetic resistance constructed on the bicycle frame 11 which is fastened pivotally with the magnetic wheel 12. The magnetic wheel 12 is lined with a non-magnetic layer 13 on the rim. The arc-shaped seat for magnets 15 with magnetic pieces 14 is fixed at an interior edge of the bicycle frame 11 beneath the magnetic wheel 12. The arc-shaped seat 15 uses an adjustment device 16 to adjust the space between the magnetic pieces 14 and the magnetic wheel 12 for controlling and damping the force of turning the magnetic wheel (as shown in FIGS. 3 and 4).

However, such construction as described above is defective in design because the surface of the magnetic wheel 12 still needs to be lined with a non-magnetic layer 13. Therefore, if the lining of the non-magnetic layer 13 is not stable, then it will easily fall off; and furthermore, if the curvature of the lining of the non-magnetic layer 13 is different from the magnetic wheel 12, then it will affect the rotational inertia of the magnetic wheel 12, or even rub against the magnets of the arc-shaped seat 15.

In addition, because the magnetic wheel 12 and arc-shaped seat 15 are fastened on the bicycle frame 11, the positioning causes the magnetic wheel 12 to be able to be easily deviated from its pivoting place on the frame 11 after being used over a long period of time; and furthermore, it causes the free space between the magnetic wheel 12 and the arc-shaped seat 15 to change such that the adjustment device 16 is not able to accurately change and control the magnetic resistance of damping force.

SUMMARY OF THE INVENTION

The primary objective of the present invention is to provide an improved control of magnetic resistance for an exercise bicycle which is free from the drawbacks of the non-magnetic layer installation as found in the prior art exercise bicycles as described above.

The present invention has a non-magnetic layer lined directly onto the interior edge of the arc-shaped seat for magnets to match the curve of the magnetic wheel. Such special construction in design provides stable protection. The installation of the non-magnetic layer accurately matches the curve of the magnetic wheel. The effect on control of magnetic resistance is excellent. Furthermore, the construction is cost-effective.

Another feature of the present invention focuses on improving upon the drawback of prior art magnetic wheels when the wheel deviates and changes the free space between the wheel and the arc-shaped seat. The present invention is constructed to include a through hole, a guide trough of a suspension arm, an elongated hole for a suspension bar, thread, and nut of a suspender so as to improve the stability of the magnetic wheel and the free space between the arc-shaped seat.

The foregoing objective, features, functions and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
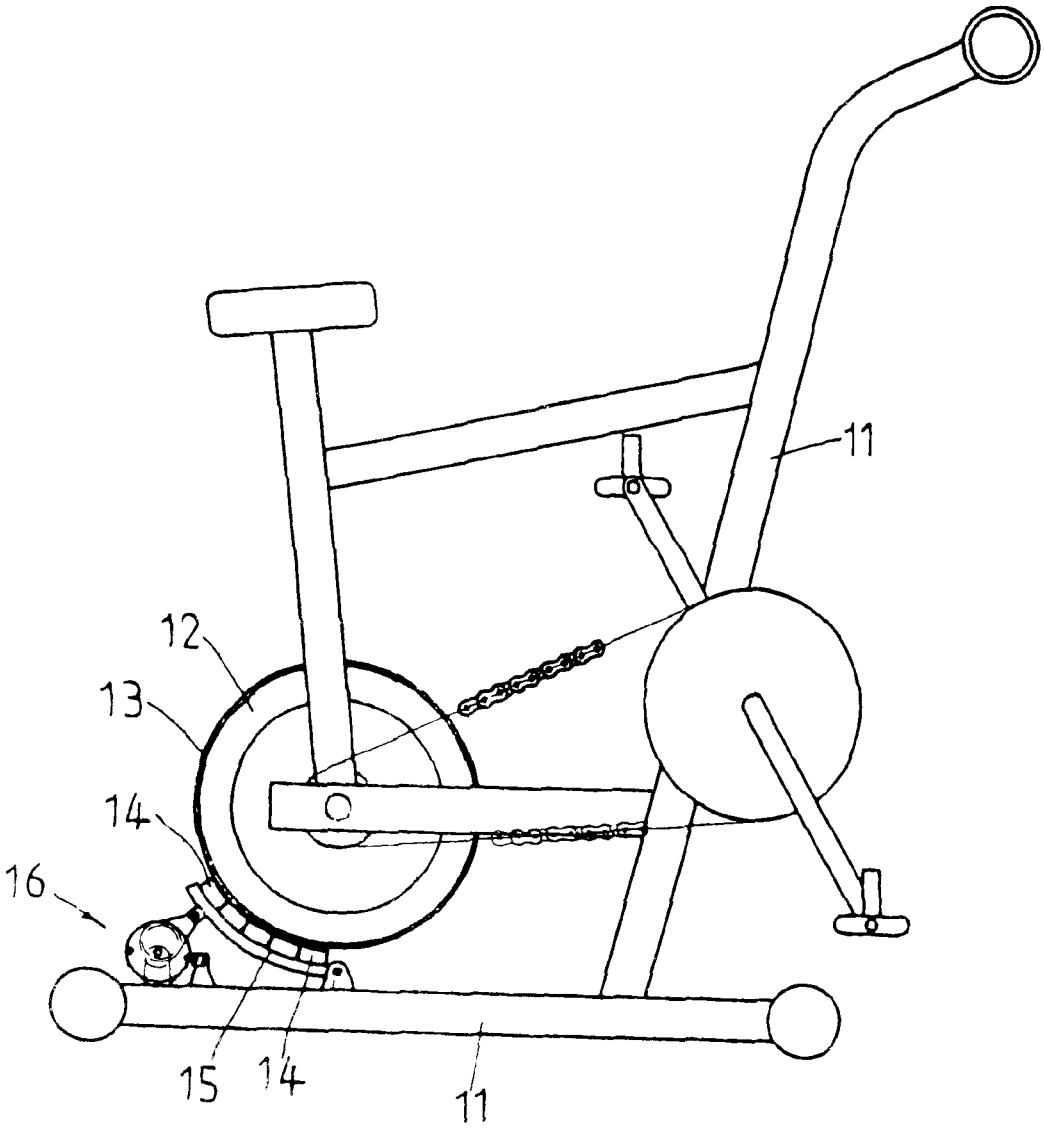
FIG.1 PRIOR ART
FIG. 1 shows a side view of a prior art exercise bicycle.
Figure 2:
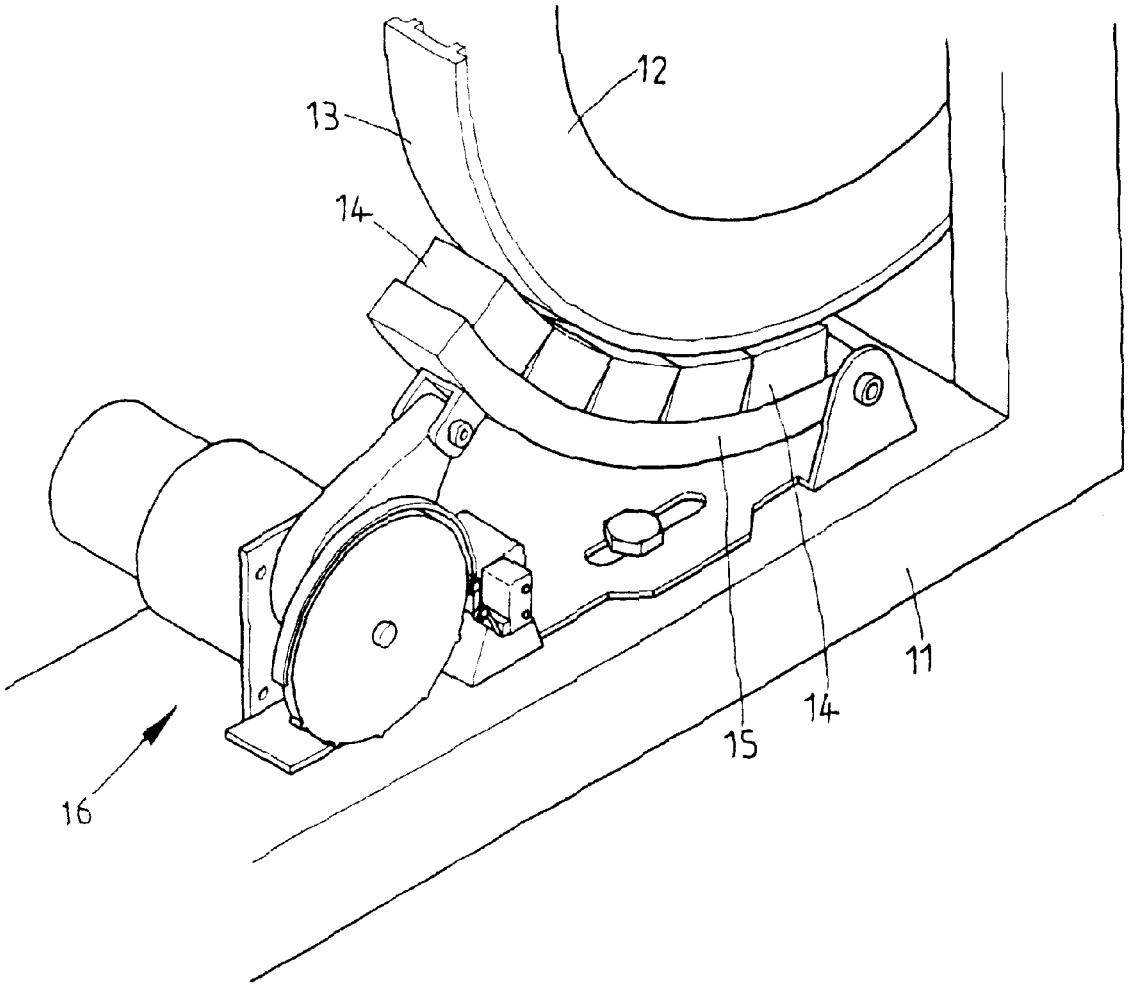
FIG.2 PRIOR ART
FIG. 2 shows a partial perspective view of a magnetic control device of the prior art exercise bicycle.
Figure 3:
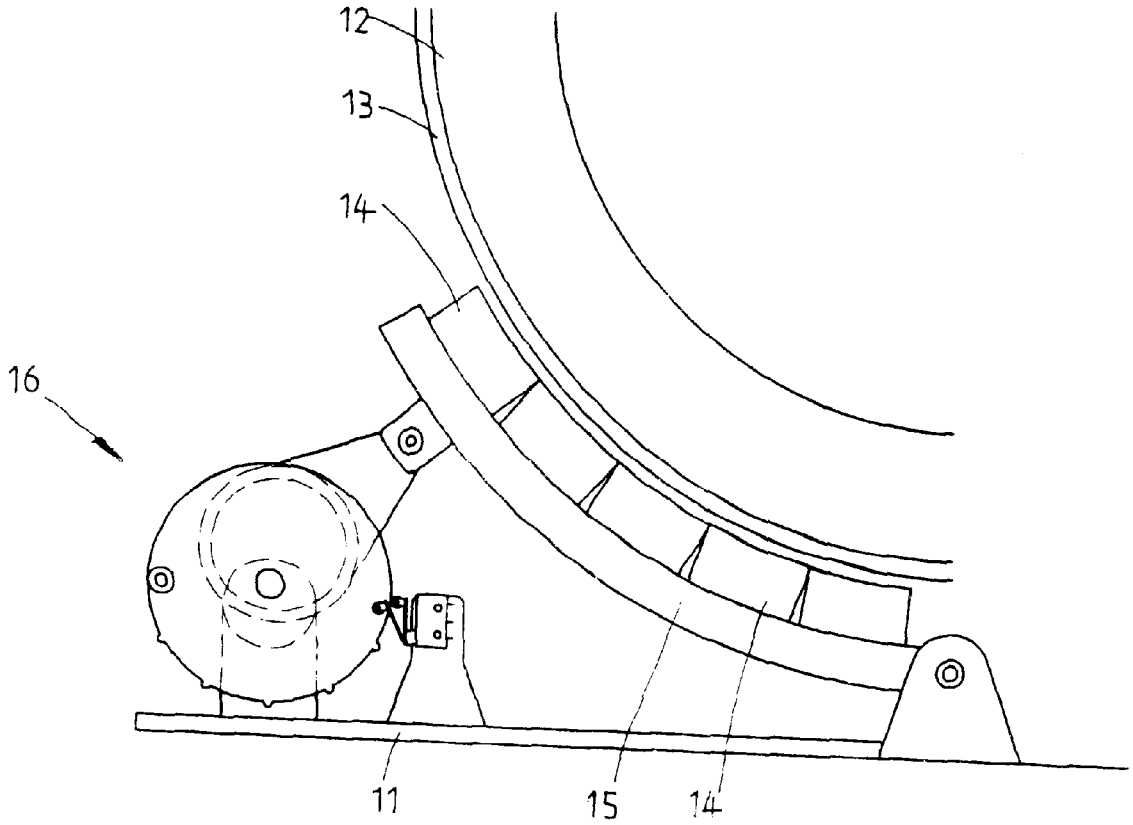
FIG.3 PRIOR ART
FIG. 3 shows partial side view of the magnetic control device of the prior art exercise bicycle.
Figure 4:
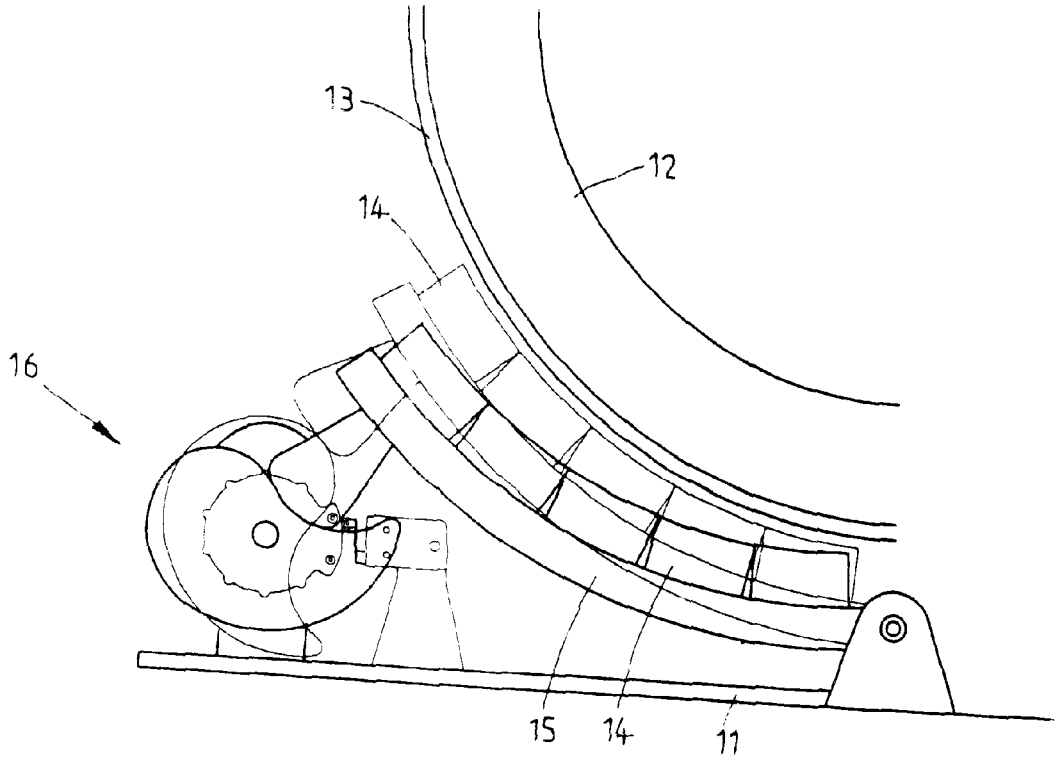
FIG.4 PRIOR ART
FIG. 4 shows a schematic view of the magnetic control device of the prior art exercise bicycle in adjusting operation.
Figure 5:
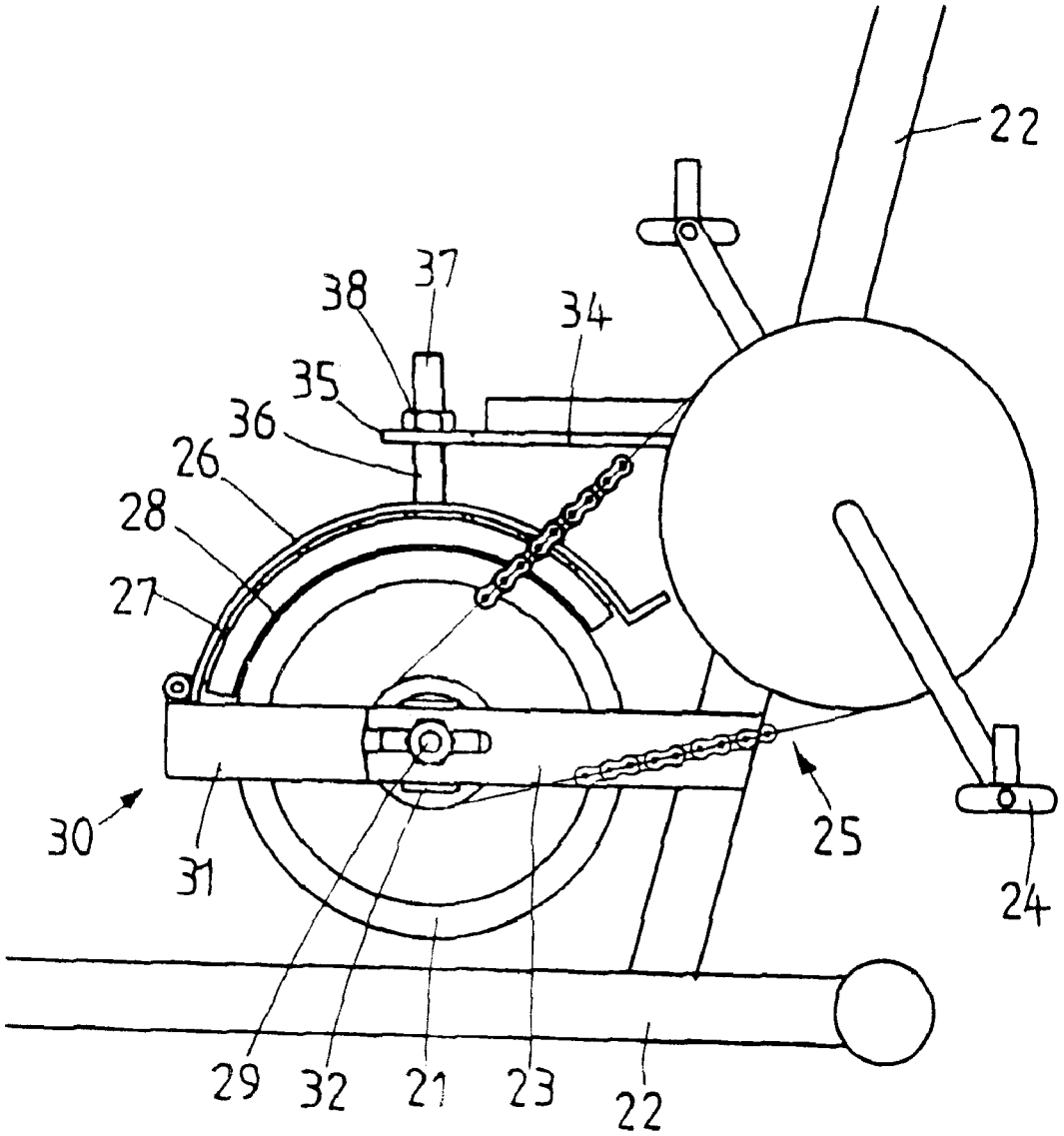
FIG. 5 shows a side view of the present invention.
Figure 6:
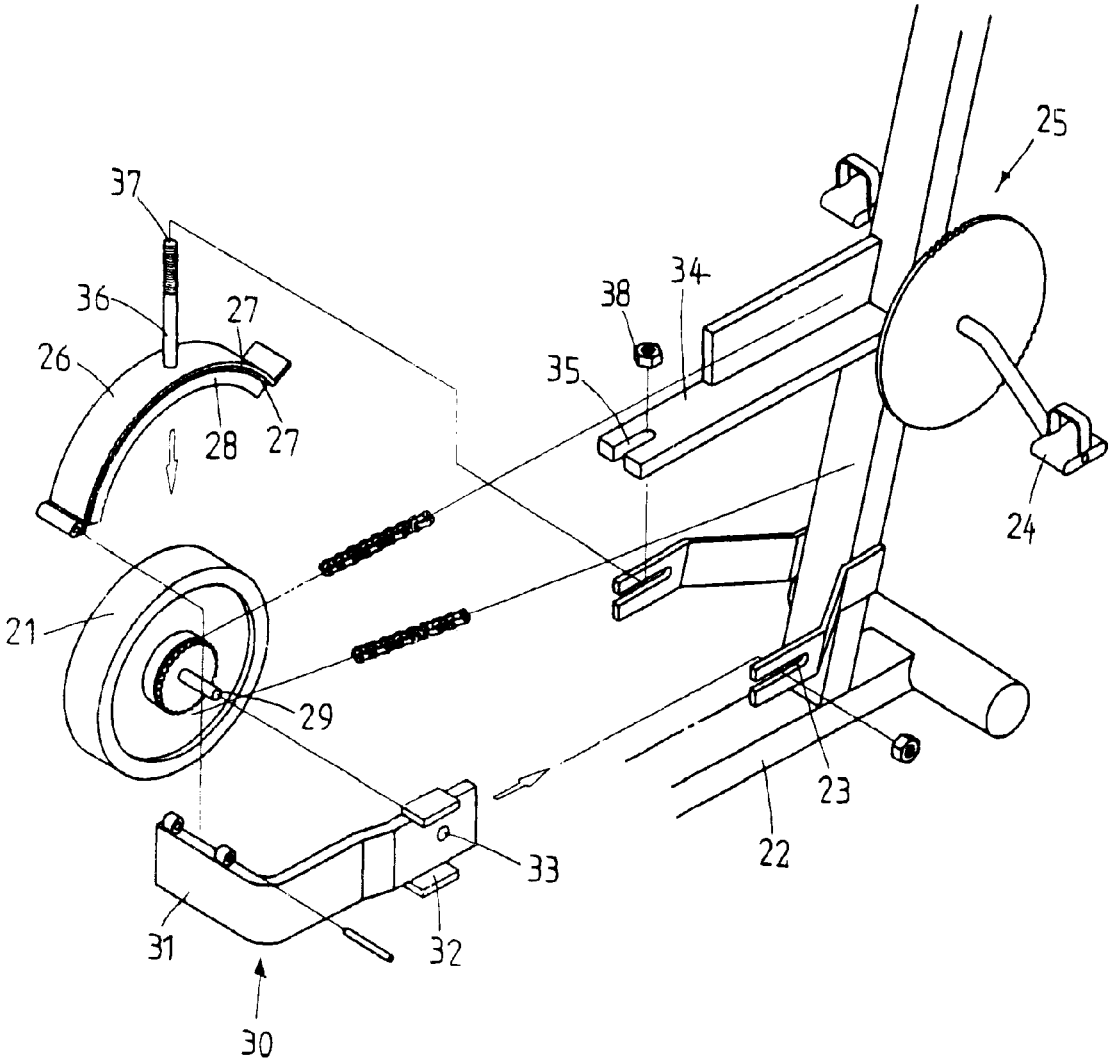
FIG. 6 shows partial exploded view of the magnetic control device of the present invention.

As shown in FIGS. 5 and 6, the present invention for an improved control of magnetic resistance for an exercise bicycle is comprised of a magnetic wheel 21, an arc-shaped seat for magnets 26, and a non-magnetic layer 28.

The magnetic wheel 21 is fastened rotatably on the fork structure 23 of the bicycle frame 22 and moved by the pedal 24 which drives the bicycle chain link motion 25.

The arc-shaped seat 26 uses the suspended device 30 to mount directly along the curve of the magnetic wheel 22, so as to enable each magnetic piece 27 located at the interior edge of the arc-shaped seat 26 to closely contact the surface of the magnetic wheel 21.

The non-magnetic layer 28 is positioned adjacent the interior surface of the arc-shaped seat 26 over the magnetic pieces 27.

With the construction as described above, the present invention stabilizes the arc-shaped seat 26 by the installation of the non-magnetic layer adjacent the interior surface thereof.

Figure 7:
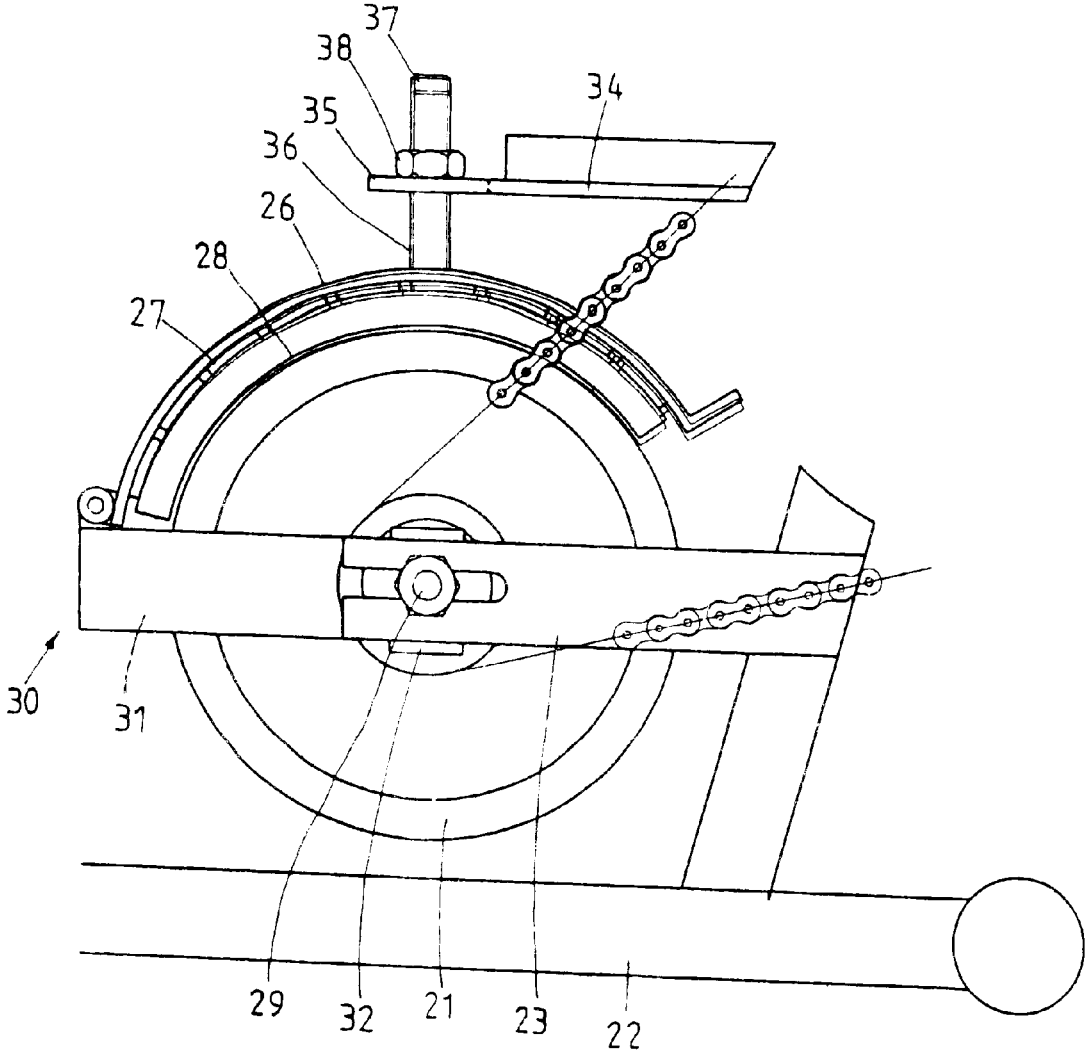
FIG. 7 shows a schematic view of the magnetic control device of the present invention in adjusting operation.

As shown in FIGS. 6 and 7, the suspended device 30 is comprised of a suspension arm 31, a suspension bar 34, and a suspender 36.

The suspension arm 31 forms a guide trough 32 at the inner end thereof for engaging the fork structure 23 of the bicycle frame 22 and provides a through hole 33 for aligning the axle 29 of the magnetic wheel 21. Therefore, the suspension arm 31 aligns onto the axle 29 of the magnetic wheel 21 to fasten onto the fork structure 23 of bicycle frame 22. In addition, the outer end of the suspension arm 31 provides a pivot for the lower end of the arc-shaped seat 26 so that the interior edge of the arc-shaped seat faces the surface of the magnetic wheel 21.

The suspension bar 34 is affixed to the bicycle frame 22 and includes an elongated hole 35 which corresponds to the upper end of the arc-shaped seat 26.

The suspender 36 is affixed to the surface of the arc-shaped seat 26 at one end thereof and has a threaded end 37 at the opposite top end thereof. The threaded end 37 passes through the elongated hole 35 and uses the nut 38 to fasten to the top of the suspension bar 34.

With the construction of the suspended device 30 as described above, the present invention can therefore achieve stability for the free space between the magnetic wheel 21 and the arc-shaped seat 26.

The feature of the present invention is the non-magnetic layer 28 directly lined onto the magnetic pieces on the interior edge of the arc-shaped seat, so that the non-magnetic layer accurately matches the curve of the magnetic wheel 21.

Another feature of the present invention is the suspension arm 31 of the suspended device 30 which uses through hole 33 to mount the axle 29 of the magnetic wheel 21, and also uses the guide trough 32 to engage the fork structure 23 of bicycle frame 22. Therefore, the mounting of the lower end of the arc-shaped seat 26 at the outer end of the aligned suspension arm 31 allows the arc-shaped seat 26 and the magnetic wheel 21 to deviate at the same time and maintain the free space therebetween, when it is used for a long time. In addition, the elongated hole 35 of the suspension bar 34 allows the suspender 36, that is connected to the arc-shaped seat 26, to move and slide along the elongated hole 35. As a result, it is possible to adjust the distance between the magnetic wheel 21 and the arc-shaped seat for magnets 26 to change and control the magnetic resistance of the damping force.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A magnetic resistance control apparatus comprising:

a bicycle frame having a fork structure extending therefrom;

a wheel having a magnetic surface thereon, said wheel being rotatably mounted on an axle received by said fork structure;

a pedal assembly rotatably connected to said bicycle frame, said pedal assembly being connected by linkage to said wheel such that a rotation of said pedal assembly causes a rotation of said wheel;

a suspension arm connected to said fork structure and extending outwardly therefrom so as to have an end positioned beyond an outer diameter of said wheel, said suspension arm having a guide trough formed thereon, said guide trough engaging said fork structure of said bicycle frame, said suspension arm having a through hole formed therein, said through hole rotatably receiving said axle therein;

a suspension bar connected to said bicycle frame and extending therefrom so as to be positioned above an outer diameter of said wheel, said suspension bar having an elongated hole formed therein;

an arc-shaped seat having magnets received on an interior surface thereof, said seat having an end pivotally connected at said end of said suspension arm, said seat extending around a portion of said wheel such that said magnets face said magnetic surface of said wheel, said seat being adjustably connected to said suspension bar so as to set a distance of said magnets from said wheel, said suspension bar positioned above said seat;

a non-magnetic layer permeable to magnetic forces, said non-magnetic layer extending directly over said magnets of said seat so as to be interposed between said magnets and said wheel;

a suspender affixed at one end to said seat, said suspender having a screw thread at an opposite end thereof, said suspender extending through said elongated hole such that said screw thread resides above said suspension bar; and a nut adjustably secured to said screw thread of said suspender, said nut contacting a top surface of said suspension bar.

* * * * *